US010191419B2

(12) United States Patent
Haruna

(10) Patent No.: US 10,191,419 B2
(45) Date of Patent: Jan. 29, 2019

(54) IMAGE FORMING APPARATUS AND METHOD FOR IMAGE FORMING APPARATUS TO CONVEY RECORDING MATERIAL HAVING AN IMAGE

(71) Applicant: CANON KABUSHIKI KAISHA, Tokyo (JP)

(72) Inventor: Jun Haruna, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/583,548

(22) Filed: May 1, 2017

(65) Prior Publication Data

US 2017/0329264 A1 Nov. 16, 2017

(30) Foreign Application Priority Data

May 11, 2016 (JP) ..... 2016-095270

(51) Int. Cl.

| | |
|---|---|
| ***G03G 15/20*** | (2006.01) |
| ***G03G 21/16*** | (2006.01) |
| *G03G 15/23* | (2006.01) |
| *G03G 15/00* | (2006.01) |

(52) U.S. Cl.

CPC ..... *G03G 15/2028* (2013.01); *G03G 15/2014* (2013.01); *G03G 15/6573* (2013.01); *G03G 21/1633* (2013.01); *G03G 21/1695* (2013.01); *G03G 15/234* (2013.01); *G03G 15/6538* (2013.01); *G03G 2215/00721* (2013.01); *G03G 2215/00734* (2013.01)

(58) Field of Classification Search

None

See application file for complete search history.

(56) References Cited

U.S. PATENT DOCUMENTS

2013/0043647 A1* 2/2013 Fujii ..... G03G 15/6564 271/226
2014/0294406 A1* 10/2014 Eguchi ..... G03G 15/706 399/22

FOREIGN PATENT DOCUMENTS

| | | |
|---|---|---|
| JP | 2004021085 A | 1/2004 |
| JP | 2009208952 A | 9/2009 |
| JP | 2010076855 A | 4/2010 |
| JP | 2011178494 A | 9/2011 |

* cited by examiner

*Primary Examiner* — Victor Verbitsky
(74) *Attorney, Agent, or Firm* — Canon U.S.A., Inc. IP Division

(57) ABSTRACT

An image forming apparatus includes an image forming unit, a fixing unit, a door for accessing the fixing unit and a member positioned on an upstream side of the fixing unit in a conveyance direction of the recording material, a conveyance path for a recording material having a length in the conveyance direction equal to or longer than a predetermined length, and a control unit. The image forming unit forms an image on a recording material. The fixing unit fixes the formed image on the recording material at a nip portion. The recording material with fixed image is conveyed on the conveyance path. In a case where a predetermined recording material is conveyed to the conveyance path when a length of the predetermined recording material in the conveyance direction is shorter than the predetermined length, the control unit stops conveyance of the nipped predetermined recording material at the nip portion.

20 Claims, 14 Drawing Sheets

IMAGE FORMING APPARATUS AND METHOD FOR IMAGE FORMING APPARATUS TO CONVEY RECORDING MATERIAL HAVING AN IMAGE

BACKGROUND OF THE INVENTION

Field of the Invention

The present disclosure relates to an image forming apparatus that includes a plurality of discharge paths in each of which sizes of sheets that are able to be discharged are different, and a method for the image forming apparatus.

Description of the Related Art

Conventionally, it has been proposed that when it is detected that a sheet, for which printing has been started, is a sheet that is not able to be conveyed on a specific conveyance path, control is performed so that the sheet is conveyed to a downstream side of a fixing portion in a sheet conveyance direction and is stopped to thereby improve processing performance when a user performs processing for the stopped sheet (for example, refer to Japanese Patent Laid-Open No. 2010-076855).

In the conventional art, however, in order to convey the sheet to the downstream side of the fixing portion in the conveyance direction and stop the sheet, an apparatus needs to be configured so that the sheet is able to be removed on the downstream side of the fixing portion in the conveyance direction. That is, when the control of the conventional art is used, it is difficult for a user to perform processing of a sheet in an image forming apparatus having a configuration in which access is allowed only to a fixing portion and an upstream side of the fixing portion in a conveyance direction.

SUMMARY OF THE INVENTION

The information in the disclosure works towards improving usability when processing is performed for a sheet that is stopped in an image forming apparatus having a configuration in which access is allowed to an upstream side of a fixing portion.

According to an aspect of the present invention, an image forming apparatus includes an image forming unit configured to form an image on a recording material, a fixing unit configured to fix the image formed by the image forming unit on the recording material at a nip portion, a door for accessing the fixing unit and a member positioned on an upstream side of the fixing unit in a conveyance direction of the recording material, a conveyance path in which a recording material, whose length in the conveyance direction is equal to or longer than a predetermined length, is able to be conveyed and the recording material on which the image has been fixed by the fixing unit is conveyed, and a control unit configured to perform control, wherein, in a case where a predetermined recording material is conveyed to the conveyance path when a length of the predetermined recording material in the conveyance direction is shorter than the predetermined length, the control unit performs control to stop conveyance of the predetermined recording material while the predetermined recording material is nipped at the nip portion.

Further features will become apparent from the following description of embodiments with reference to the attached drawings.

DESCRIPTION OF THE EMBODIMENTS

Hereinafter, embodiments will be described in detail by embodiments with reference to drawings.

[Embodiment 1]

[Image Forming Apparatus]

Figure 1:
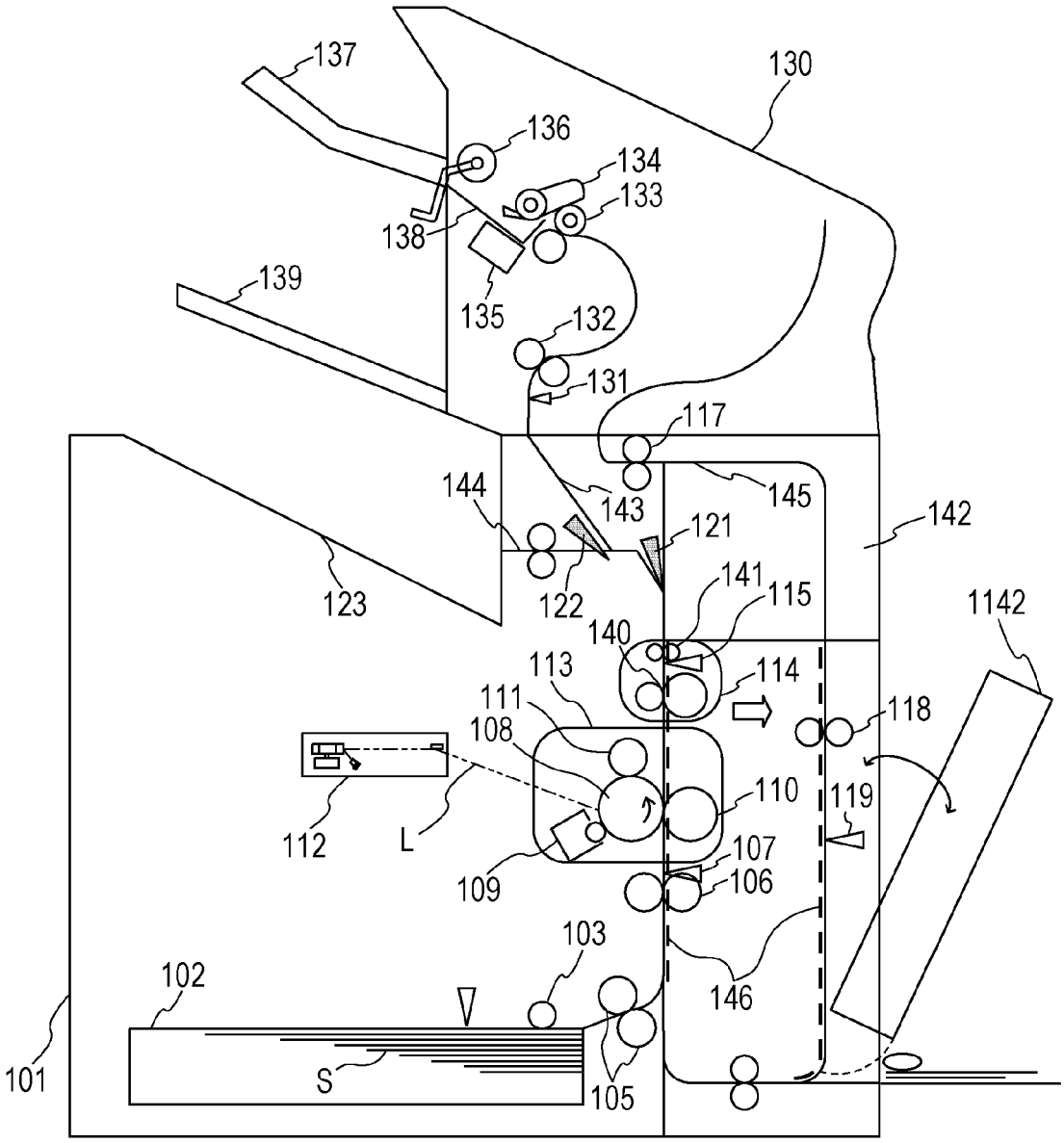
FIG. 1 is a schematic structural view of an image forming system of Embodiment 1.

FIG. 1 is a schematic structural view of an image forming apparatus of Embodiment 1. In the following description of FIG. 1, a case where a sheet serving as a recording material is conveyed to a post-processing apparatus after printing is performed will be described as an example. Upon reception of a print request from a video controller 210 (refer to FIG. 2), a laser beam printer 101 (hereinafter, a printer 101) feeds a sheet S from a sheet cassette 102 serving as a container. When the sheet S is fed from the sheet cassette 102, a feeding roller 103 is driven and the sheet S fed from the sheet cassette 102 is delivered to a conveyance path by a roller pair 105 serving as a feeding unit. The fed sheet S reaches a top sensor 107 serving as a first detection unit. When a leading edge of the sheet S is detected by the top sensor 107, timing of starting an output of an image signal is notified to the video controller 210 and the sheet S is conveyed to an image forming portion 113 serving as a forming unit. The printer 101 counts a time from timing when the leading edge of the sheet S is detected by the top sensor 107 to timing when a trailing edge of the sheet S is detected by the top sensor 107 and detects a length of the sheet S in a conveyance direction.

The image forming portion 113 includes a photosensitive drum 108 serving as a photosensitive member, a developing device 109, a transfer roller 110, and a charging roller 111. The photosensitive drum 108 is uniformly charged by the charging roller 111, and then irradiated with laser light L (two-dot chain line) according to an image signal, which is emitted from an exposure device 112, and has an electrostatic latent image formed on a surface thereof. The electrostatic latent image formed on the photosensitive drum 108 (photosensitive member) is visualized as a toner image to which toner is adhered by the developing device 109. The photosensitive drum 108 rotates in a direction (counterclockwise direction) indicated with an arrow in the figure, the toner image on the photosensitive drum 108 is conveyed to a transfer position, and the sheet S also is conveyed to the transfer position in synchronization with the rotation of the photosensitive drum 108. At the transfer position, voltage having polarity opposite to that of the toner image is applied to the transfer roller 110 and the toner image on the photosensitive drum 108 is transferred onto the sheet S (recording material). The sheet S onto which the toner image is transferred is conveyed to a fixing portion 114 serving as a fixing unit and applied with heat and pressure at a nip portion 140, so that an unfixed toner image is fixed onto the sheet S.

A conveyance destination of the sheet S onto which the toner image is fixed is decided in accordance with operations of flappers 121 and 122 serving as switching units. First, the flapper 121 serving as the switching unit switches the conveyance destination of the sheet S to an external discharge direction or a double-sided direction. Here, the external discharge direction refers to a direction in which the sheet S is discharged out of the printer 101, and specifically refers to a direction in which the sheet S is conveyed to a first discharge path 144 or a second discharge path 143. The double-sided direction refers to a direction in which the sheet S is conveyed to a double-sided conveyance path 145 in which image formation is performed on a second side of the sheet S. The flapper 121 switches the conveyance destination of the sheet S to the external discharge direction or the double-sided direction when a first predetermined time has lapsed after timing when the leading edge of the sheet S is detected by a fixing sensor 115 serving as a second detection unit. The sheet S conveyed to the double-sided direction has the conveyance direction reversed by a roller 117 and is conveyed to the double-sided conveyance path 145. The flapper 122 serving as the switching unit further switches the conveyance destination of the sheet S conveyed to the external discharge direction to the first discharge path 144 or the second discharge path 143. The flapper 122 switches the conveyance destination of the sheet S to the first discharge path 144 or the second discharge path 143 when a second predetermined time has lapsed after timing when the leading edge of the sheet S is detected by the fixing sensor 115. The sheet S conveyed to the first discharge path 144 is discharged onto a discharge tray 123. On the other hand, the sheet S conveyed to the second discharge path 143 is conveyed to a post-processing apparatus 130 and subjected to various post-processing.

After the conveyance destination is switched to the external discharge direction by the flapper 121 and the conveyance destination is further switched to the second discharge path 143 serving as a first conveyance path by the flapper 122, the sheet S is conveyed to the post-processing apparatus 130. In the post-processing apparatus 130, when the leading edge of the sheet S is detected by an inlet sensor 131, the sheet S is conveyed by an inlet roller 132 serving as a second conveyance unit and conveyed to a discharge roller 133. An intermediate stacking portion 138 in which a plurality of sheets S are temporarily stored is provided on the downstream side of the discharge roller 133 in the conveyance direction. A jogger 137 that supports both edges of the sheet S in a width direction which is a direction substantially orthogonal to the conveyance direction of the sheet S and that aligns edges of a plurality of sheets S in the width direction is provided on the downstream side of the intermediate stacking portion 138 in the conveyance direction. The inlet roller 132 is a conveyance unit configured to be arranged on the most upstream side in the conveyance direction among conveyance units provided on the conveyance path which is in the post-processing apparatus 130 (in the post-processing apparatus) and which continues to the second discharge path 143.

Since one stacking portion is formed by both the jogger 137 and the intermediate stacking portion 138, the sheet S is stacked across the jogger 137 and the intermediate stacking portion 138. An alignment paddle 134 that aligns edges of a plurality of sheets S in the conveyance direction is provided above on the upstream side of the jogger 137 in the conveyance direction, and a discharge roller 136 is provided on the downstream side of the alignment paddle 134 in the conveyance direction. Note that, the alignment is an operation of aligning edges of the plurality of sheets S in the conveyance direction or the width direction. The discharge roller 136 is able to selectively switch a state in contact with the sheet S stacked on the intermediate stacking portion 138 and the jogger 137 and a state spaced apart from the sheet S.

The intermediate stacking portion 138 has a stapler 135 serving as a binding unit that performs stapling processing for binding edges of a sheet bundle formed by the plurality of aligned sheets S. A stacking portion 139 is provided vertically below the jogger 137. When the discharge roller 136 is in contact with the sheet S stacked on the intermediate stacking portion 138 and the jogger 137 and the jogger 137 is at a retracted position, the sheet S conveyed to the post-processing apparatus 130 is discharged onto the stacking portion 139 without being temporarily stacked on the intermediate stacking portion 138.

When the post-processing apparatus 130 performs the stapling processing, the post-processing apparatus 130 receives the sheets S from the printer 101 with the inlet roller 132 and conveys the sheets S to the discharge roller 133. The post-processing apparatus 130 then conveys the sheets S with the discharge roller 133 to the intermediate stacking portion 138 on which the sheets S are temporarily stacked. At this time, the discharge roller 136 is being spaced apart from the sheets S. When the sheets S are conveyed to the intermediate stacking portion 138, the jogger 137 moves to a position at which the sheets S are able to be received. Both edges of the sheets S in the width direction are supported and conveyed to the intermediate stacking portion 138 and the jogger 137. The jogger 137 aligns the stacked sheets S in the width direction of the sheets S. In addition, the alignment paddle 134 performs alignment in the conveyance direction. After the alignment of the sheets S in the conveyance direction by the alignment paddle 134 ends, the stapling processing is performed by the stapler 135. When the discharge roller 136 is in contact with the sheets S which have been subjected to the stapling processing, a sheet bundle subjected to the stapling processing is discharged onto the stacking portion 139 and a series of processing ends. Note that, the series of processing is controlled by an engine CPU 201 and a post-processing apparatus CPU 220 (refer to FIG. 2) described later.

The printer 101 of the present embodiment also is able to perform double-sided printing. A conveyance direction of the sheet S on which fixing of the toner image formed on a first side thereof is completed is switched (switched back) by the roller 117 and conveyed to the double-sided conveyance path 145. The sheet S is conveyed by a double-sided conveyance roller 118 and is conveyed again to the image forming portion 113 to have a toner image formed on a second side thereof. A double-sided conveyance sensor 119 that detects the sheet S is arranged on the double-sided conveyance path 145.

[Size of Sheet that is Able to be Conveyed]

Next, a relation of sizes of sheets S that are able to be conveyed to the first discharge path 144 serving as a second conveyance path and the second discharge path 143 will be described. Among sheets S on which printing is executable when a sheet S is discharged onto the discharge tray 123 outside the printer 101, a length (hereinafter, a minimum sheet size) of the sheet S in the conveyance direction, which is the shortest length in the conveyance direction, is set as Lh. A minimum sheet size which has a predetermined length with which printing is executable when the sheet S is discharged onto the second discharge path 143 is set as La. The relation between the minimum sheet size Lh and the minimum sheet size La is as follows. The minimum sheet size La is a length of a first recording material in the conveyance direction, which is the shortest length in the conveyance direction among the sheets S that are able to be conveyed to the second discharge path 143. The minimum sheet size Lh is a length of a second recording material in the conveyance direction, which has the shortest length in the conveyance direction among the sheets S that are able to be conveyed to the first discharge path 144.

$$Lh<La \quad (1)$$

Note that, in the present embodiment, the minimum sheet size La has a value decided in accordance with a distance from a fixing sheet-discharge roller 141 serving as a first conveyance unit to the inlet roller 132 along the conveyance path. The fixing sheet-discharge roller 141 is arranged on the most downstream side in the conveyance direction among conveyance units provided on the conveyance path in the printer 101 when the sheet S is conveyed to the second discharge path 143. The inlet roller 132 is arranged on the most upstream side in the conveyance direction among conveyance units provided on the conveyance path in the post-processing apparatus 130. On the other hand, the minimum sheet size Lh has a value decided in accordance with a distance between the roller pair 105 and a conveyance roller 106 serving as a fifth conveyance unit along the conveyance path.

[Door]

A door through which the sheet S (hereinafter, also referred to as a residual sheet) that stops and remains on the conveyance path is removed from the conveyance path in the present embodiment will be described. When a door 142 serving as an opening and closing portion of the present embodiment is brought into an opened state, attachment/detachment of the fixing portion 114 is allowed. The door 142 allows access not only to the fixing portion 114 but also to a member arranged on the upstream side of the fixing portion 114 in the conveyance direction. The door 142 is configured to allow access to the inside of the apparatus in order to remove the sheet S that stops in a region indicated with broken line 146 on the conveyance path which is on the upstream side of the fixing sheet-discharge roller 141 in the conveyance direction and is on the downstream side in the conveyance direction on the double-sided conveyance path 145.

The state where the door 142 is opened is indicated with a door opened state 1142 (dotted line) of FIG. 1. A door closed state is indicated with solid line. In the present embodiment, the sheet S that stops at the fixing portion 114 is able to be removed from the printer 101 by bringing the door 142 into the door opened state 1142 and moving the fixing portion 114 to a direction indicated with a white-filled arrow of FIG. 1. In the present embodiment, the sheet S that stops at the fixing portion 114 is able to be removed by bringing the door 142 into the door opened state 1142 and pulling out a trailing edge of the sheet S along the conveyance path to a direction (lower direction in FIG. 1) on the upstream side in the conveyance direction.

As described in FIG. 1, a user is not able to access a member arranged on the downstream side of the fixing portion 114 in the conveyance direction only by opening the door 142. When the fixing portion 114 is moved to the direction indicated with the white-filled arrow of FIG. 1 and detached from the printer 101, a few access is allowed to the downstream side, but access to a deep inside of the second discharge path 143 is still not allowed. In this case, though a configuration in which a door is provided also in the post-processing apparatus 130 to allow a user to access a vicinity of the inlet roller 132 also is considered, such a configuration results in a cost increase and an increase in a size of the apparatus.

[Control Block Diagram]

Figure 2:
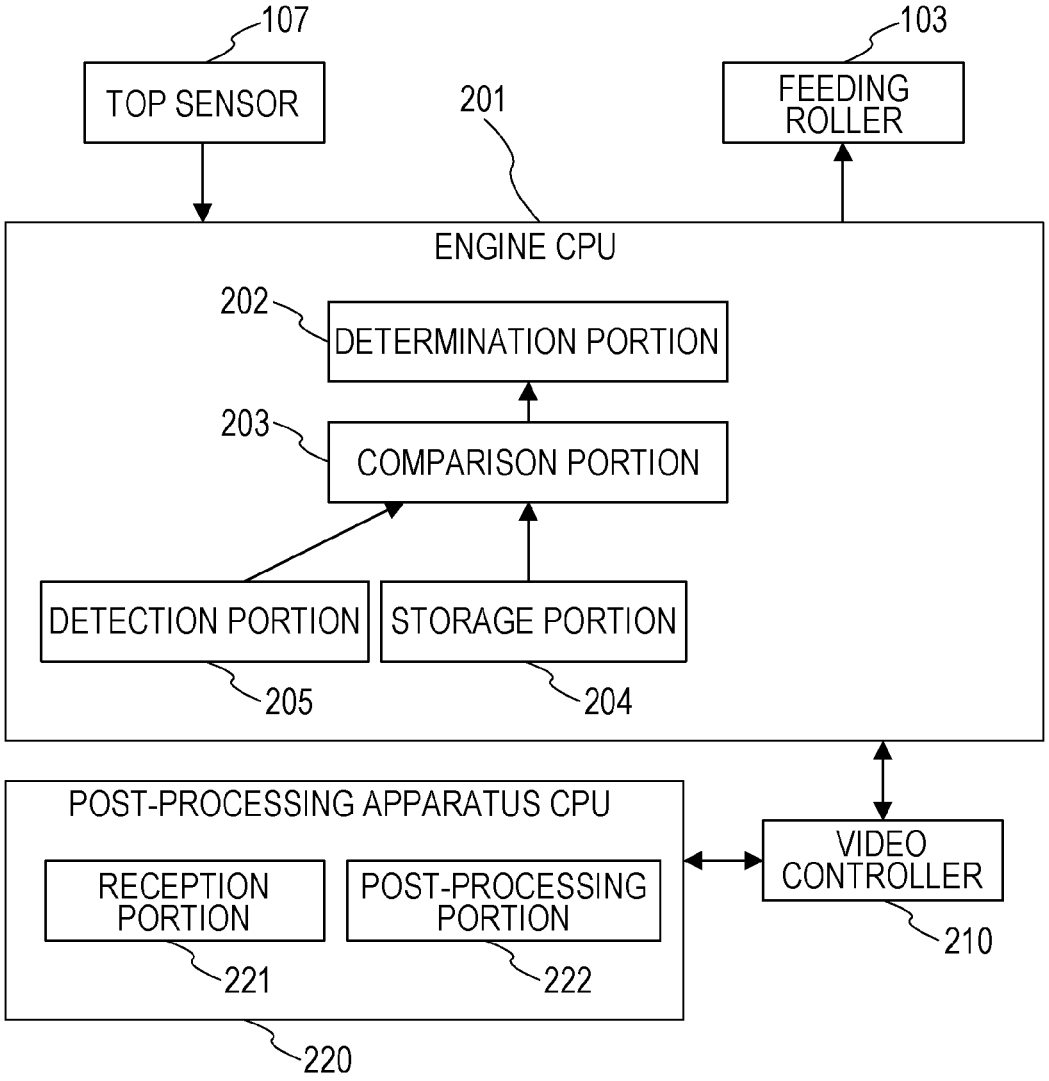
FIG. 2 is a control block diagram of the image forming system of Embodiment 1.

FIG. 2 is a control block diagram of an image forming system of the present embodiment. The printer 101 has the engine CPU 201 (hereinafter, referred to as a CPU 201) that controls an operation thereof. The post-processing apparatus 130 has the post-processing apparatus CPU 220 (hereinafter, referred to as a CPU 220) that controls an operation thereof. Each of the CPU 201 and the CPU 220 has an arithmetic processing circuit, a ROM, a RAM, a timer, and the like inside thereof and operates while using the RAM as a working area based on a program written in the ROM in advance. Each of the CPU 201 and the CPU 220 performs control of various timing via a timer. The top sensor 107 is connected to the CPU 201.

The CPU 201 includes a determination portion 202 serving as a determination unit that determines stop timing and a comparison portion 203 serving as a comparison unit that compares lengths of sheets in the conveyance direction (referred to as sheet lengths). The CPU 201 includes a storage portion 204 in which a sheet length of a sheet that is able to be received by the second discharge path 143 is stored and a detection portion 205 serving as a detection unit that detects a sheet length. The CPU 220 includes a reception portion 221 serving as a reception unit that receives the sheet S by the post-processing apparatus 130 and a post-processing portion 222 serving as a post-processing unit. The video controller 210 transmits a printing condition, a print request, and image data to the CPU 201. The video controller 210 also transmits, to the CPU 220, a carry-in notice and a post-processing condition with respect to the post-processing apparatus 130.

With the configuration as described above, issues are addressed, such as the following.

(1) When the sheet S remains on the downstream side of the fixing portion 114 in the conveyance direction, the residual sheet S is not able to be detected, so that sheet jamming (hereinafter, referred to as jamming) is caused by the residual sheet.

(2) When the sheet S remains on the downstream side of the fixing portion 114 in the conveyance direction and when a length of the residual sheet S is short, the sheet S is not able to be processed by the printer 101 itself or by a user, so that jamming is caused.

(3) Usability is deteriorated due to unfixed toner on the sheet S that stops at the fixing portion 114. That is, when the user performs processing of the sheet S, his/her hand is contaminated by the unfixed toner.

A method will be described below.

In the present embodiment, by considering that the sheet S nipped at the nip portion 140 is pulled out to the upstream side in the conveyance direction, the sheet S is stopped on the upstream side in the conveyance direction as far as possible from the fixing portion 114, so that processing is made much easier. The printer 101 of the present embodiment stops while nipping the sheet S at the nip portion 140. Thereby, when the fixing portion 114 is detached, the fixing portion 114 is able to be taken out from the printer 101 while the residual sheet is nipped at the nip portion 140. Thus, visibility is enhanced when the residual sheet is removed, and a processing error is able to be prevented. Further, the printer 101 of the present embodiment stops while the sheet S is nipped at the nip portion 140. Thus, when conveyance of the sheet S is stopped, the fixing sensor 115 keeps a state where the sheet S is detected. Thereby, when the sheet S is processed, the fixing sensor 115 detects that the sheet S is not on the conveyance path. In this manner, the fixing sensor 115 is able to detect that the residual sheet S is processed in the present embodiment.

[Method of Stopping Sheet]

A method of stopping the sheet S that is not able to be conveyed to the second discharge path 143 connected to the post-processing apparatus 130 in the present embodiment will be described with reference to FIGS. 3A to 3E. FIGS. 3A to 3E illustrate a state of sheet conveyance in the printer 101 (in the image forming apparatus) when printing is performed by using the post-processing apparatus 130. Note that, a first sheet S is set as a sheet S1. The following (A) to (E) correspond to (A) to (E) of FIGS. 3A to 3E.

(A) The feeding roller 103 is driven, the first sheet S1 serving as a predetermined recording material is fed, the sheet S1 is conveyed by the roller pair 105 and the conveyance roller 106, and image formation on a first side of the sheet S1 starts at timing when a leading edge of the sheet S1 is detected by the top sensor 107.

(B) The leading edge of the sheet S1 is detected by the fixing sensor 115, and then, after a predetermined time has lapsed, the flapper 121 is switched to the external discharge direction. Moreover, the flapper 122 is switched to the direction of the post-processing apparatus 130.

(C) Based on timing when a trailing edge of the sheet S1 is detected by the top sensor 107, a sheet length of the sheet S1 is determined, and when the sheet length is equal to or longer than the predetermined length La, conveyance is continued.

(D) At timing when the sheet S1 is conveyed to the post-processing apparatus 130, in other words, at timing when the trailing edge of the sheet S1 has passed through the printer 101, printing of the printer 101 ends. Note that, the printing operation in this case also includes operations such as a conveyance operation of the sheet S1, and when these operations end, the printing ends. The timing when the trailing edge of the sheet S1 has passed through the printer 101 is obtained based on timing when the trailing edge of the sheet S1 is detected by a sensor (the fixing sensor 115 in the present embodiment) positioned on the most downstream side in the conveyance direction among the sensors arranged on the conveyance path of the printer 101. (E) Based on timing when the trailing edge of the sheet S1 is detected by the top sensor 107, the sheet length of the sheet S1 is determined, and when the sheet length is less than the predetermined length La, transfer of a toner image onto the sheet S1 is stopped. Then, the conveyance is continued to a position at which a whole of the toner image transferred onto the sheet S1 is fixed. At timing when the whole the toner image transferred onto the sheet S1 is fixed, the sheet S1 is stopped while the sheet S1 is nipped at the nip portion 140, the video controller 210 is notified that the sheet S1 is a sheet that is not able to be conveyed, and the printing ends. Timing when the sheet S1 is stopped is decided based on timing when transfer of the toner image onto the sheet S1 is stopped, a distance between the transfer position and the nip portion 140 along the conveyance path, and a conveyance speed of the sheet S1.

Note that, as clear from FIGS. 3A to 3E, in the configuration of the present embodiment, at the timing when the trailing edge of the sheet S1 is detected by the top sensor 107, the leading edge of the sheet S1 passes through the flapper 122 and enters the second discharge path 143. That is, when the sheet length is less than the predetermined length La, a conveyance destination of the sheet S1 is not able to be switched to the discharge tray 123 (first discharge path 144).

[Sheet Conveyance Control of Present Embodiment]

Figure 4:
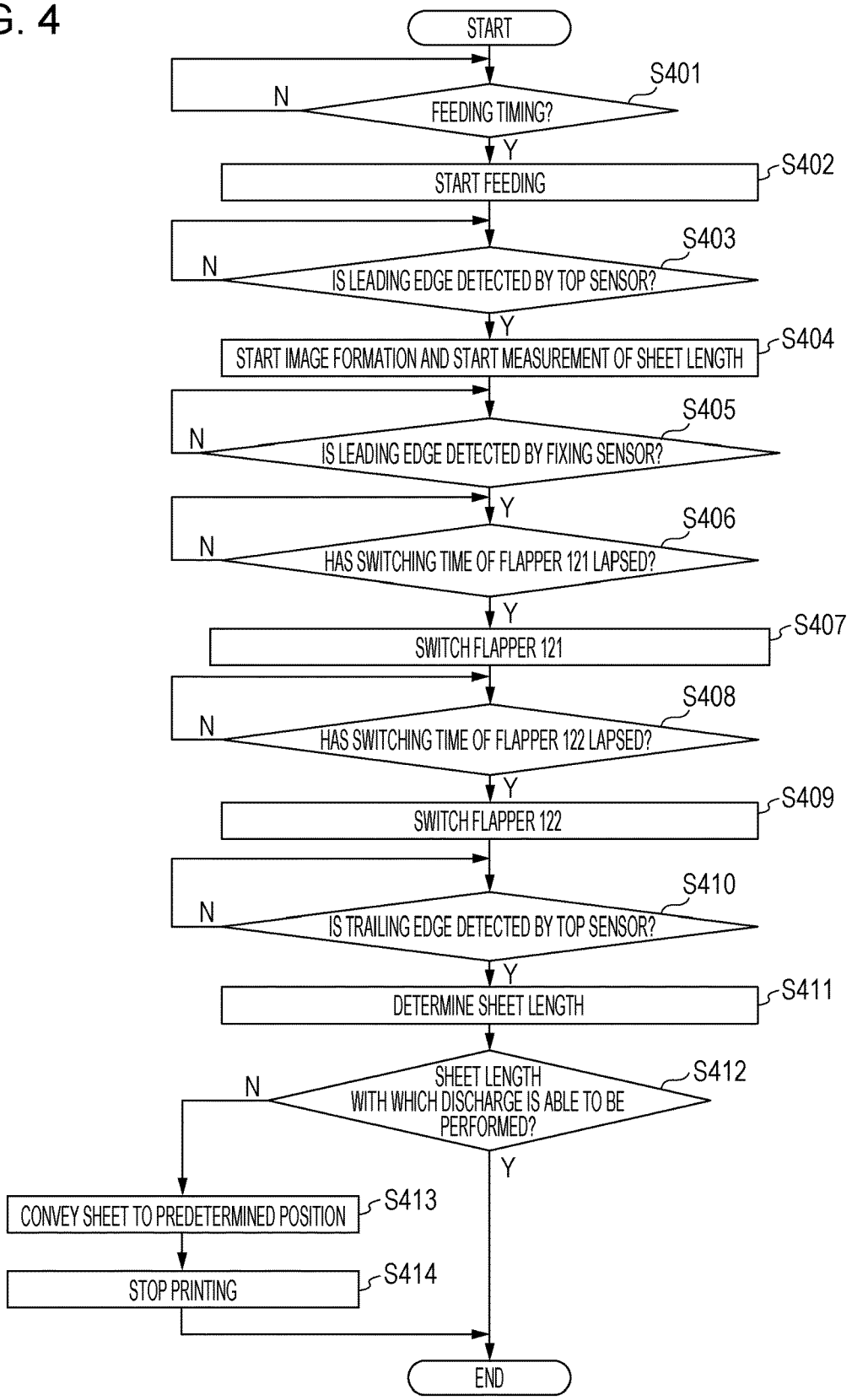
FIG. 4 is a flowchart illustrating sheet conveyance processing of Embodiment 1.

FIG. 4 is a flowchart for explaining a sheet conveyance operation of the present embodiment. Upon reception of a print request from the video controller 210, the CPU 201 of the printer 101 prepares printing. After completing the preparation for the printing, the CPU 201 starts processing subsequent to step (hereinafter, referred to as S) 401. At S401, the CPU 201 determines whether or not timing (sheet-feeding timing) of feeding the sheet S1 has come. When the CPU 201 determines at S401 that the sheet-feeding timing has not come, processing is returned to S401, and when the CPU 201 determines that the sheet-feeding timing has come, the processing proceeds to S402. The sheet-feeding timing for the first sheet S1 of a print job is timing when preparation for a sheet feeding operation is completed.

Figure 3A:
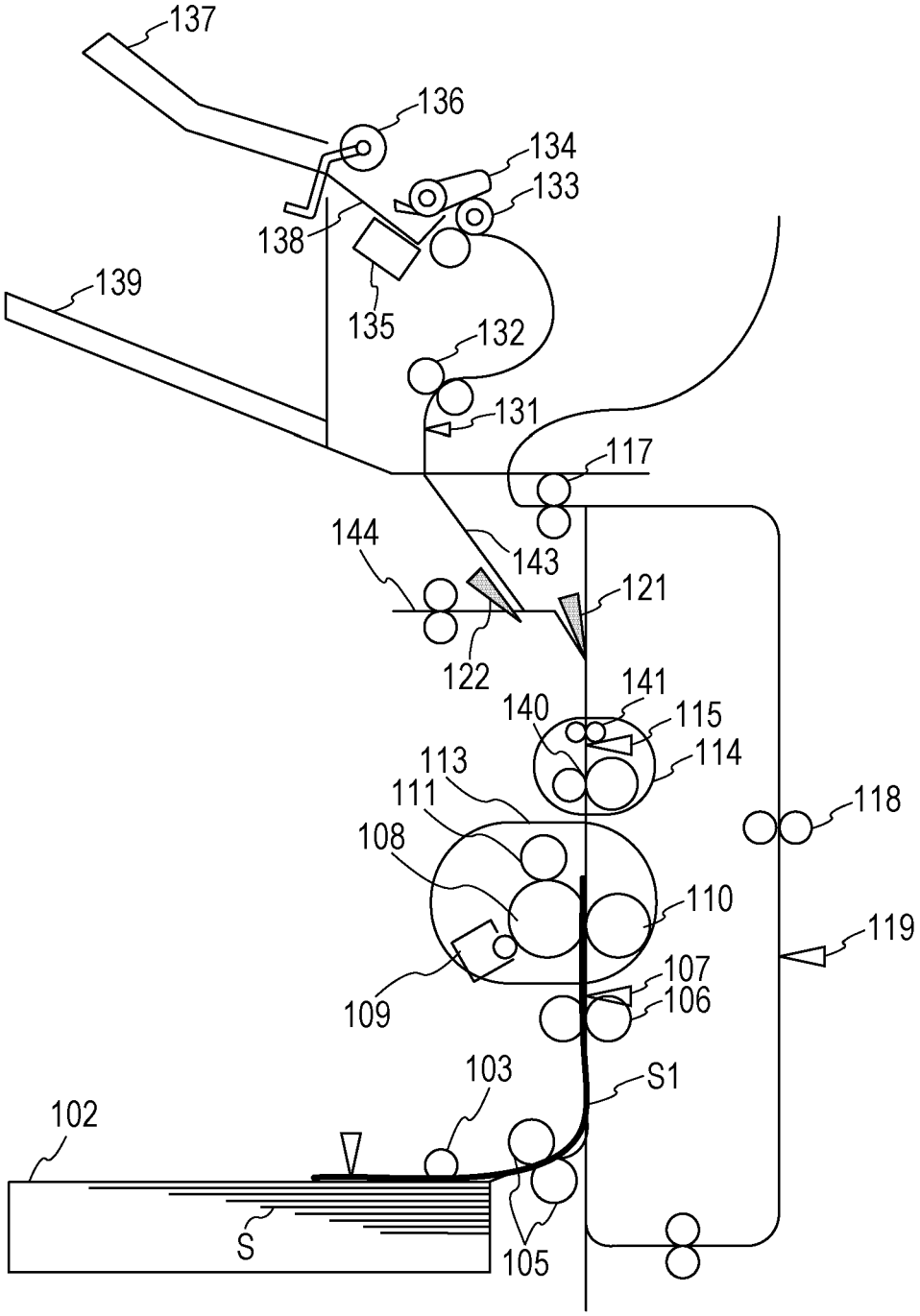
FIGS. 3A to 3E illustrate processing of stopping a sheet in Embodiment 1.

The CPU 201 starts feeding of the sheet S1 at S402. At S403, the CPU 201 determines whether or not the leading edge of the sheet S1 is detected by the top sensor 107. When the CPU 201 determines at S403 that the leading edge of the sheet S1 is not detected by the top sensor 107, the processing is returned to S403, and when the CPU 201 determines that the leading edge of the sheet S1 is detected, the processing proceeds to S404. At S404, the CPU 201 notifies, to the video controller 210, that timing of starting an output of an image signal has come, that is, start of image formation. In addition, the CPU 201 starts measurement of the sheet length of the sheet S1 by the detection portion 205 (FIG. 3A). The detection portion 205 starts counting of time by resetting and starting a timer 1 (not illustrated), for example. At S405, the CPU 201 determines whether or not the leading edge of the sheet S1 is detected by the fixing sensor 115. When the CPU 201 determines at S405 that the leading edge of the sheet S1 is not detected by the fixing sensor 115, the processing is returned to S405, and when the CPU 201 determines that the leading edge of the sheet S1 is detected, the CPU 201 resets and starts a timer 2 (not illustrated) and the processing proceeds to S406.

Figure 3B:
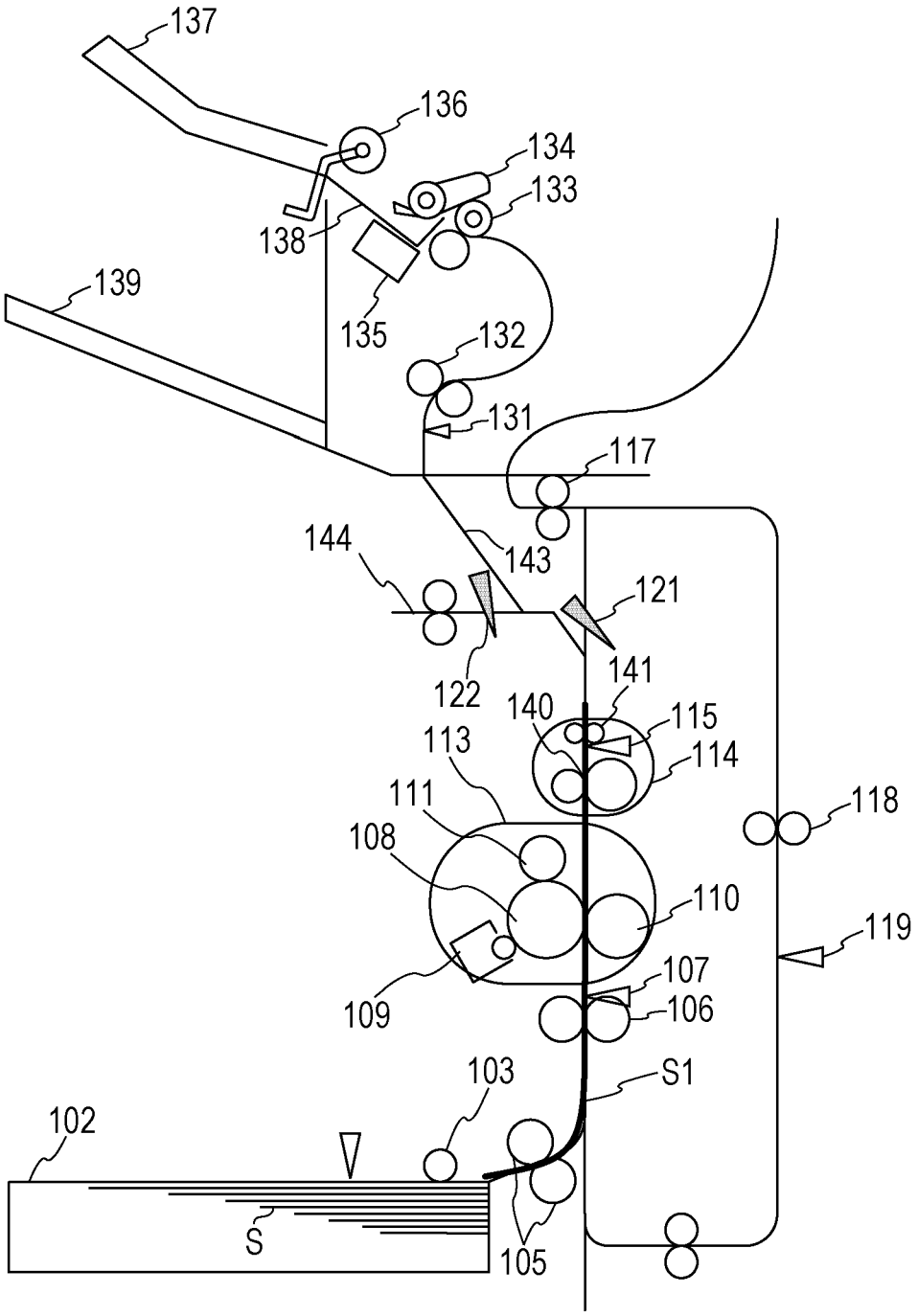
Figure 3C:
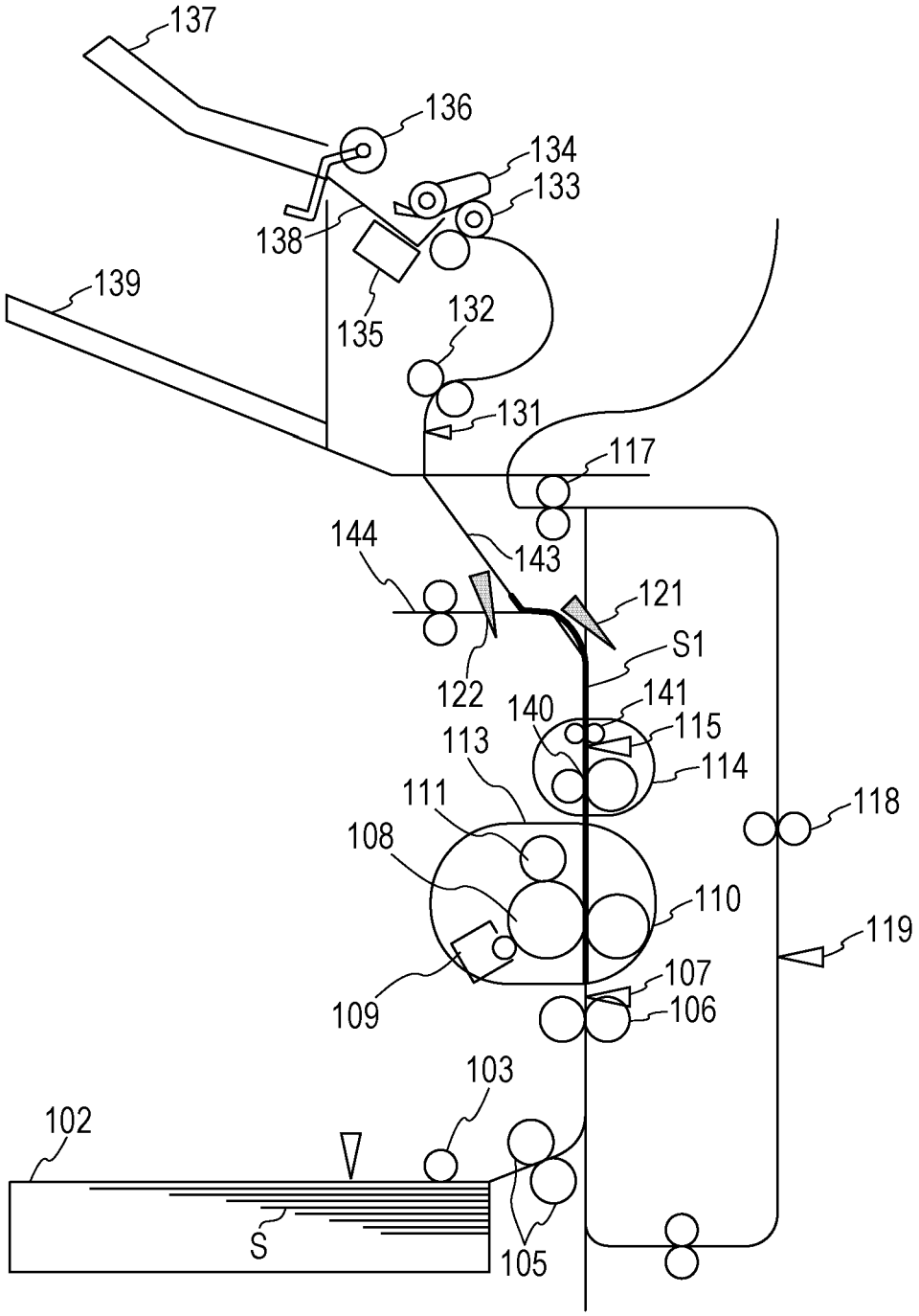

At S406, the CPU 201 determines whether or not a switching time (the first predetermined time described above) of the flapper 121 has lapsed by referring to the timer 2. When the CPU 201 determines at S406 that the switching time has not lapsed, the processing is returned to S406, and when the CPU 201 determines that the switching time has lapsed, the processing proceeds to S407. At S407, the CPU 201 switches the flapper 121 to the external discharge direction. At S408, the CPU 201 determines whether or not a switching time (the second predetermined time described above) of the flapper 122 has lapsed by referring to the timer 2. When the CPU 201 determines at S408 that the switching time has not lapsed, the processing is returned to S408, and when the CPU 201 determines that the switching time has lapsed, the processing proceeds to S409. Note that, counting of the timer used for determining whether or not the switching time of the flapper 122 has lapsed may be performed based on the time when the flapper 121 is switched at S406. The CPU 201 switches the flapper 122 to the second discharge path direction at S409 (FIG. 3B).

At S410, the CPU 201 determines whether or not passing of the trailing edge of the sheet S1 is detected by the top sensor 107. When the CPU 201 determines at S410 that the trailing edge of the sheet S1 is not detected, the processing is returned to S410, and when the CPU 201 determines that the trailing edge of the sheet S1 is detected, the processing proceeds to S411. At S411, the CPU 201 ends the measurement started at S403 for the sheet length of the sheet S1 by the timer 1 and performs determination of the sheet length by the detection portion 205. Specifically, the detection portion 205 determines the sheet length of the sheet S1 in accordance with a time difference between the time when the leading edge of the sheet S1 is detected by the top sensor 107 and the time when the trailing edge of the sheet S1 is detected by the top sensor 107. The sheet length determined by the detection portion 205 based on a detection result of the top sensor 107 is set as a sheet length L.

Figure 3D:
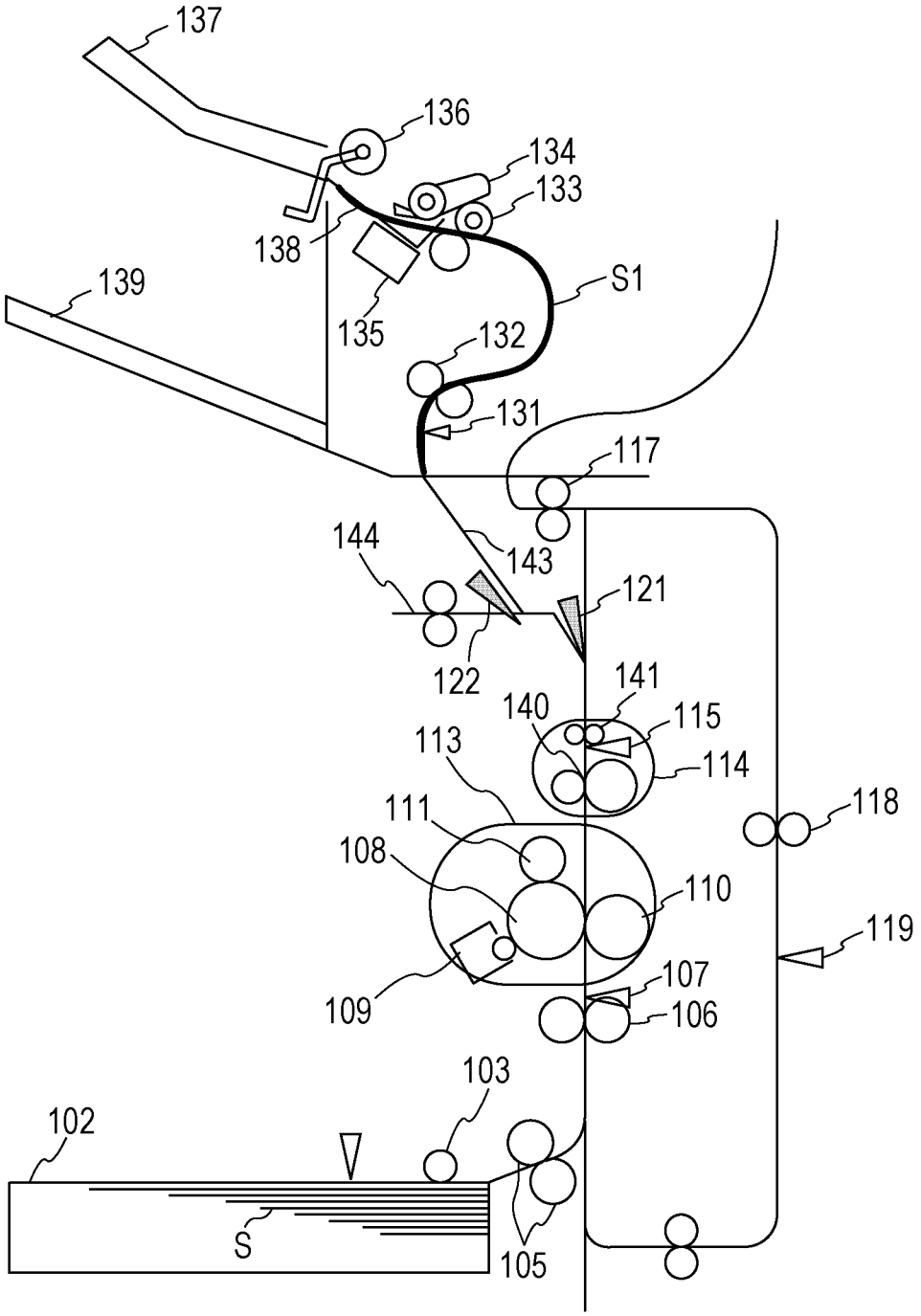
Figure 3E:
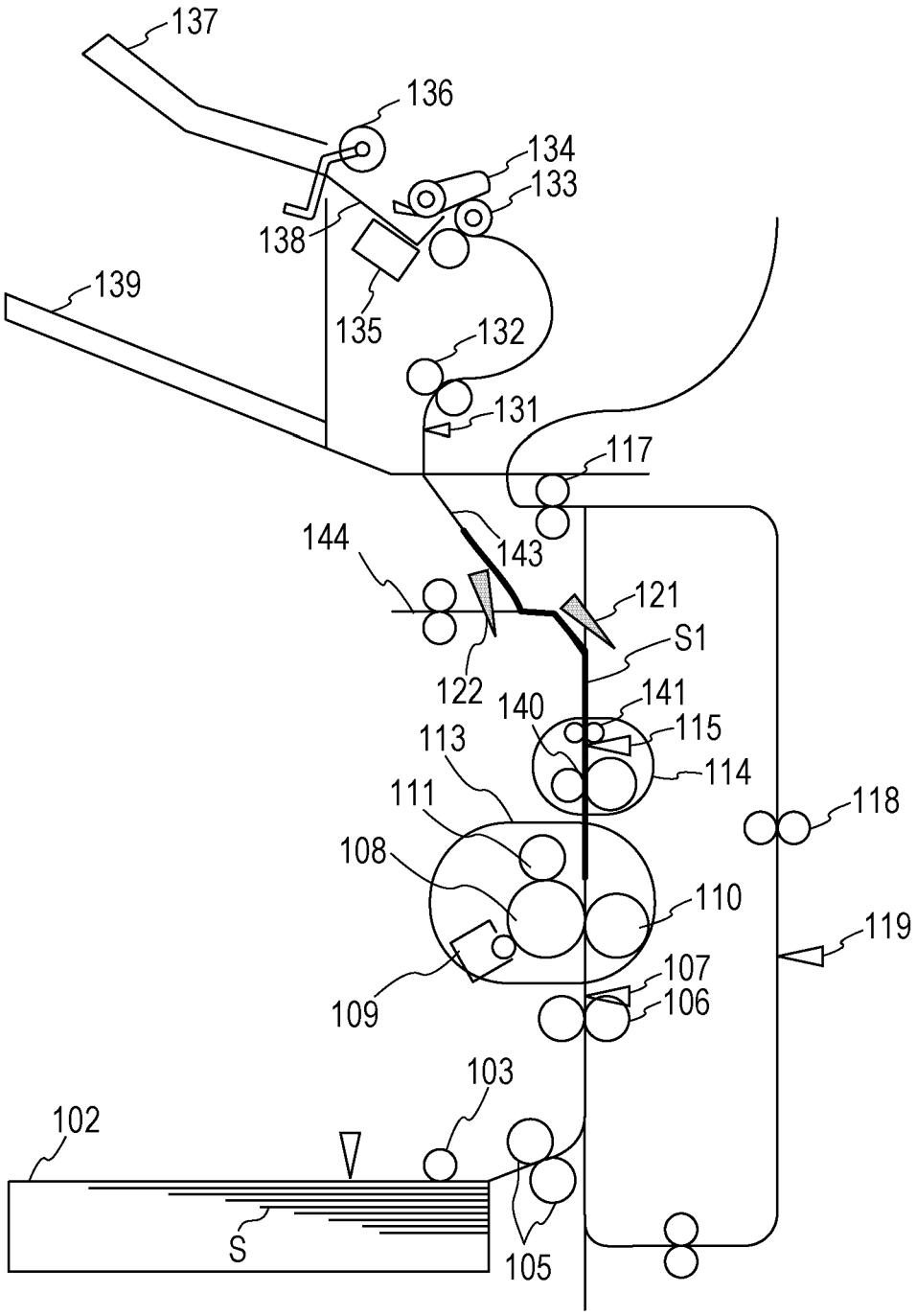

At S412, with the use of the comparison portion 203, the CPU 201 compares the sheet length L determined by the detection portion 205 and the sheet length La that is able to be received by the second discharge path 143, which is stored in the storage portion 204. Based on a comparison result of the comparison portion 203, the CPU 201 determines whether or not to be the sheet length with which discharge onto the second discharge path 143 is allowed. Specifically, when the sheet length L of the sheet S1 measured by the detection portion 205 is equal to or more than the minimum sheet size La, the comparison portion 203 determines that the discharge is allowed, and when the sheet length L is less than the minimum sheet size La, the comparison portion 203 determines that the discharge is not allowed. When the CPU 201 determines at S412 that the sheet length L of the sheet S1 is a length of a sheet that is able to be discharged onto the second discharge path 143 based on the comparison result of the comparison portion 203 (FIG. 3C), the processing ends (FIG. 3D). When the CPU 201 determines at S412 that the sheet length L of the sheet S1 is not a length of a sheet that is able to be discharged onto the second discharge path 143 based on the comparison result of the comparison portion 203 (FIG. 3E), the processing proceeds to S413. At S413, the CPU 201 stops transfer of the toner image onto the sheet S1 and the sheet S1 is conveyed until stop timing determined by the determination portion 202 has come. In this case, the stop timing is timing when the conveyance of the sheet S1 is stopped, for example, timing when a predetermined time has lapsed after timing when transfer of the toner image onto the sheet S1 is stopped. The predetermined time is obtained based on the distance between the transfer position and the nip portion 140 along the conveyance path and the conveyance speed of the sheet S1 as described above. The sheet S1 is conveyed until a whole of an unfixed toner image on the sheet S1 is fixed, that is, the CPU 201 continues the conveyance of the sheet S1 to a position (predetermined position) at which a whole of the toner image that has been already transferred onto the sheet S1 passes through the nip portion 140. The predetermined position is a position according to the predetermined time described above. At timing when the whole of the toner image transferred onto the sheet S1 is fixed, that is, at the stop timing, the CPU 201 immediately stops the conveyance of the sheet S1 while the sheet S1 is nipped at the nip portion 140. The CPU 201 notifies, to the video controller 210, that the sheet S1 is a sheet that is not able to be conveyed and stops printing at S414.

With such control, processing is able to be performed as follows even when the sheet length L of the sheet S is less than the sheet length La and printing is stopped. That is, the door 142 is brought into the opened state and the sheet S stopping on the upstream side of the fixing portion 114 in the conveyance direction is pulled out or taken out together with the fixing portion 114, so that the sheet S is able to be processed. Since the sheet S is able to be removed with the unfixed toner image that is transferred onto the sheet S fixed by the fixing portion 114, when the user removes the sheet S, his/her hand is not contaminated by the unfixed toner image. As above, according to the present embodiment, it is possible to increase usability when processing is performed for a sheet that is stopped in an image forming apparatus having a configuration in which access is allowed to the upstream side of the fixing portion.

[Embodiment 2]

[Double-sided Mechanism]

A schematic structural view and a control block diagram of the printer 101 of the present embodiment are similar to those of Embodiment 1, so that the description thereof will be omitted. In the present embodiment, a case where the sheet S after fixation is conveyed to the double-sided conveyance path 145 serving as a first conveyance path when double-sided printing is performed will be described. A relation of sizes of sheets that are able to be conveyed to the first discharge path 144 and the double-sided conveyance path 145 will be described. In the present embodiment, among sheets S on which printing is executable when performing discharge onto the discharge tray 123, a minimum sheet size of the sheet S which has the shortest length in the conveyance direction is set as Lh. In addition, among sheets S on which printing is executable when performing discharge onto the double-sided conveyance path 145, a minimum sheet size serving as a predetermined length of the sheet S that has the shortest length in the conveyance direction is set as Lr. The relation between the minimum sheet size Lh and the minimum sheet size Lr is as follows. The minimum sheet size Lr is a length of a first recording material in the conveyance direction, which is the shortest length in the conveyance direction among the sheets S that are able to be conveyed to the double-sided conveyance path 145.

$$Lh<Lr \tag{2}$$

Note that, the minimum sheet size Lr of the present embodiment has a value decided in accordance with a distance from the roller 117 serving as a third conveyance unit to the double-sided conveyance roller 118 serving as a fourth conveyance unit. The roller 117 is a roller capable of normal rotation and reverse rotation to convey the sheet S to the double-sided conveyance path 145. The double-sided conveyance roller 118 is arranged on the most upstream side in the conveyance direction among conveyance units provided on the conveyance path in the double-sided conveyance path 145.

[Sheet Conveyance Control of Present Embodiment]

Processing of stopping the sheet S that is not able to be conveyed to the double-sided conveyance path 145 in the present embodiment will be described with reference to FIGS. 5A to 5E. FIGS. 5A to 5E illustrate a state where the sheet S1 is conveyed in the printer 101 when double-sided printing is performed. Note that, the following (A) to (E) correspond to (A) to (E) of FIGS. 5A to 5E.

(A) The feeding roller 103 is driven, a first sheet S1 serving as a predetermined recording material is fed and conveyed by the roller pair 105 and the conveyance roller 106, and at timing when a leading edge of the sheet S1 is detected by the top sensor 107, image formation on a first side starts.

(B) The leading edge of the sheet S1 is detected by the fixing sensor 115, and after a predetermined time has lapsed, the flapper 121 is switched to the double-sided direction.

(C) Based on timing when a trailing edge of the sheet S1 is detected by the top sensor 107, a sheet length L of the sheet S1 is determined, and when the sheet length L is equal to or more the minimum sheet size Lr (L≥Lr), conveyance of the sheet S1 is continued.

(D) At timing when the leading edge of the sheet S1 is detected by the double-sided conveyance sensor 119, printing for the first side ends.

(E) Based on timing when the trailing edge of the sheet S1 is detected by the top sensor 107, the sheet length L of the sheet S1 is determined, and when the sheet length L is less than the minimum sheet size Lr (L<Lr), transfer of a toner image onto the sheet S1 is stopped. The sheet S1 is continued to be conveyed to a position at which a whole of the toner image transferred onto the sheet S1 is fixed, and at timing when the whole of the toner image transferred onto the sheet S1 is fixed, the sheet S1 is stopped while the sheet S1 is nipped at the nip portion 140. The video controller 210 is notified that the sheet S1 is a sheet that is not able to be conveyed, and the printing ends.

[Sheet Conveyance Control of Present Embodiment]

Figure 6:
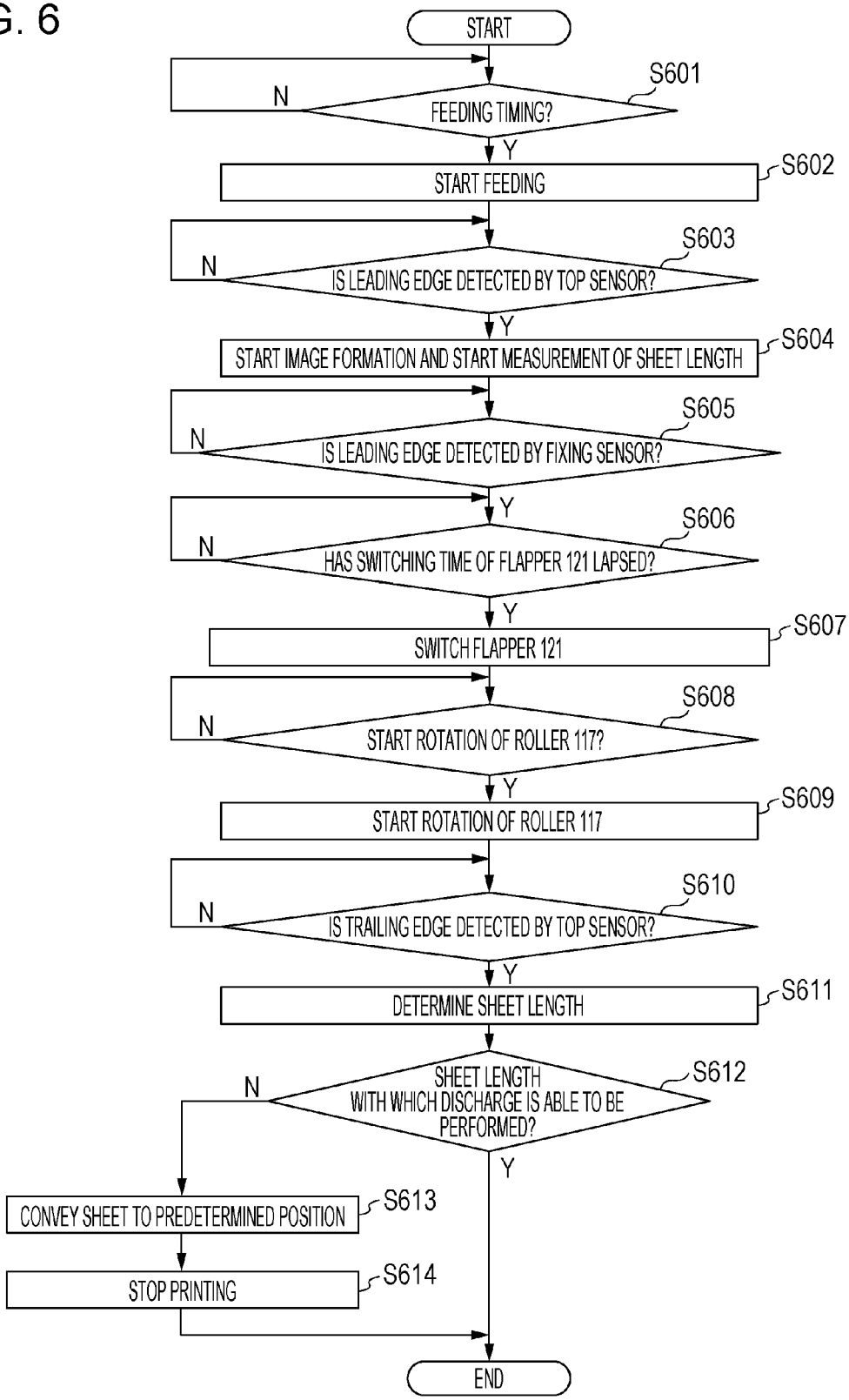
FIG. 6 is a flowchart illustrating sheet conveyance processing of Embodiment 2.

FIG. 6 is a flowchart illustrating control of the present embodiment. When the printer 101 receives a print request from the video controller 210, the CPU 201 prepares printing. After completing the preparation for the printing, the CPU 201 starts processing subsequent to S601. Note that, processing from S601 to S606 is similar to processing from S401 to S406 of FIG. 4, so that the description thereof will be omitted. Here, the processing of S604 of FIG. 6 corresponds to FIG. 5A. Note that, similarly to Embodiment 1, in the present embodiment as well, at S604, the CPU 201 resets and starts the timer 1 (not illustrated) by the detection portion 205 and thereby starts measurement of the sheet length L of the sheet S1.

Figure 5A:
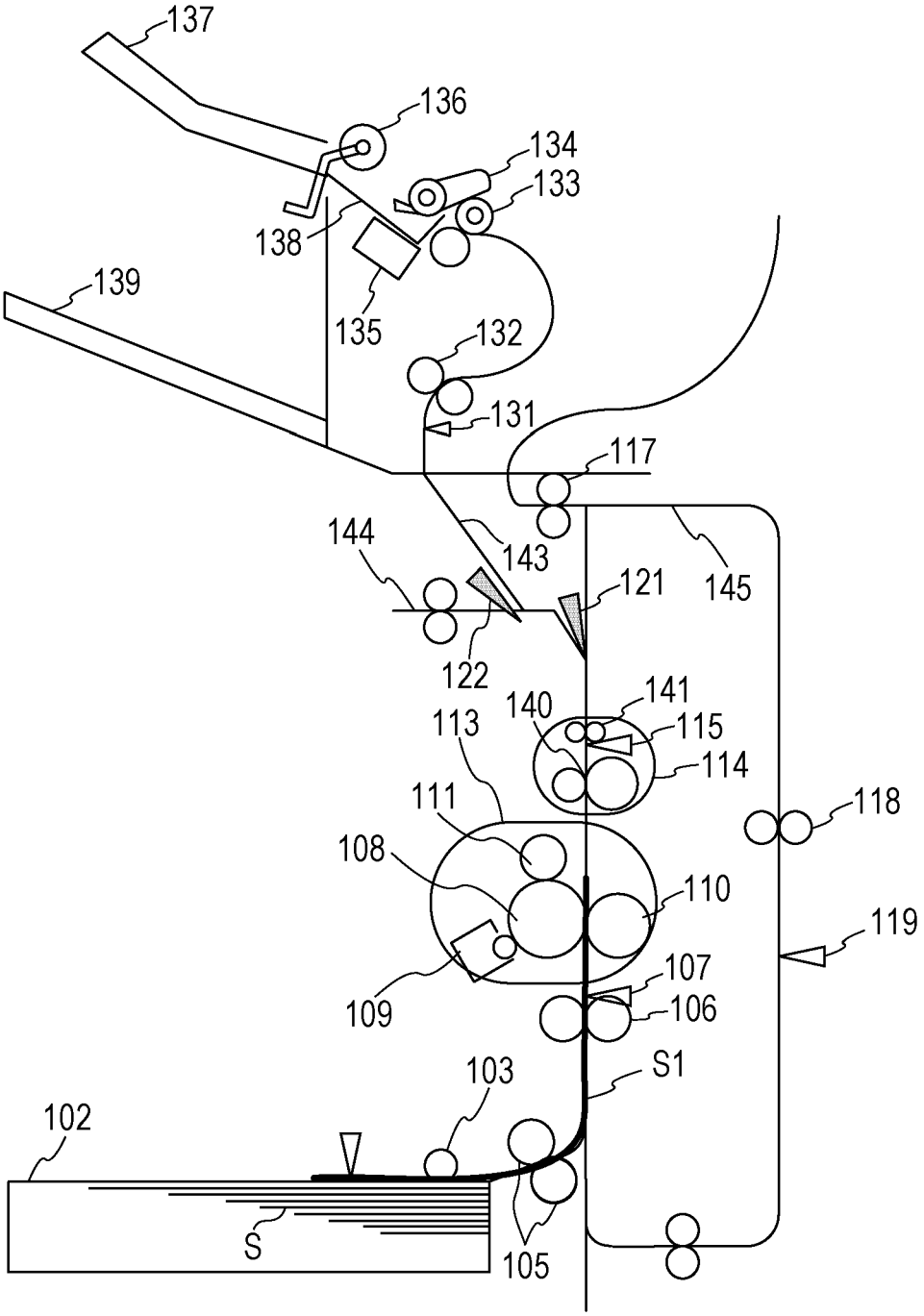
FIGS. 5A to 5E illustrate processing of stopping a sheet in Embodiment 2.
Figure 5B:
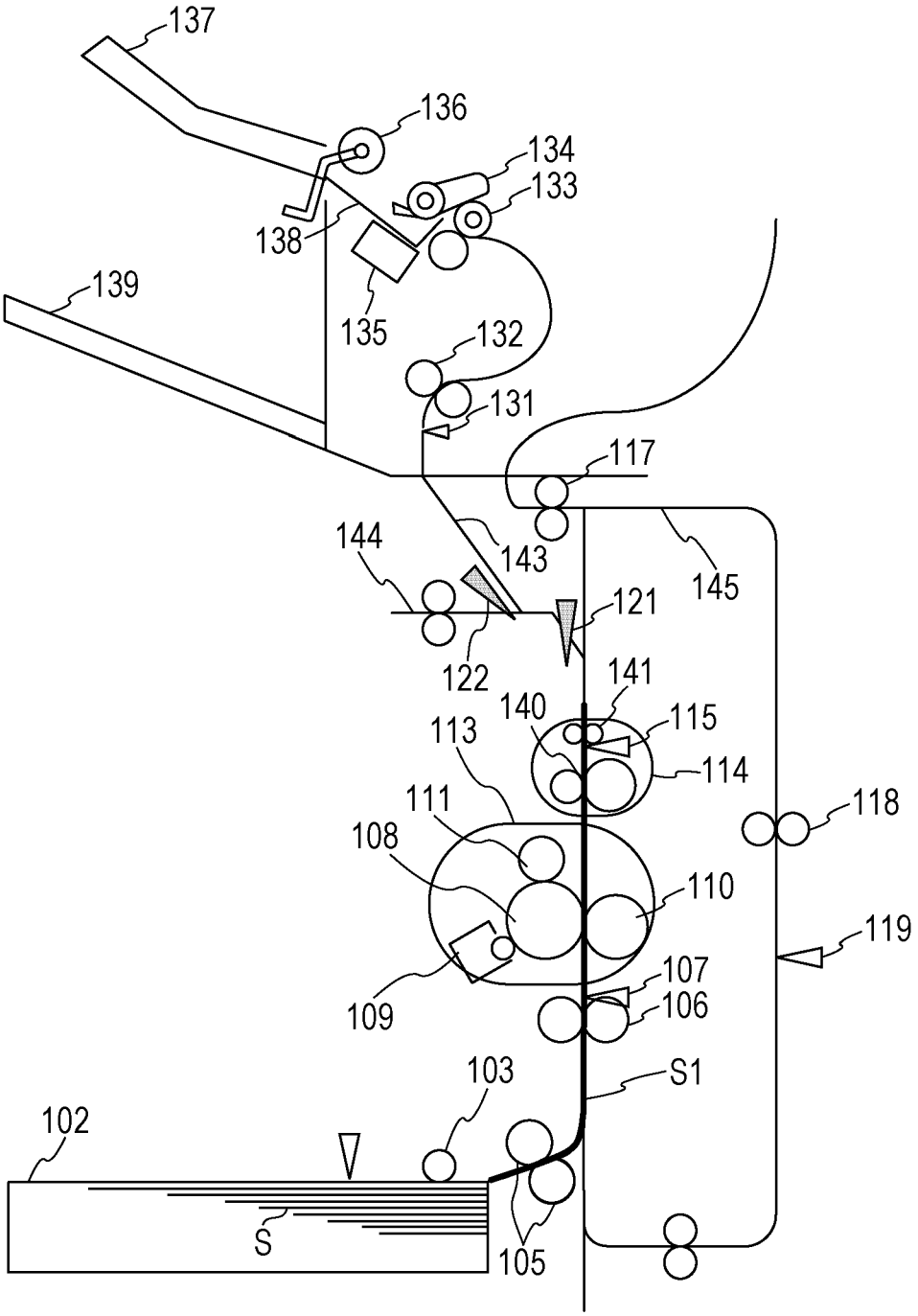
Figure 5C:
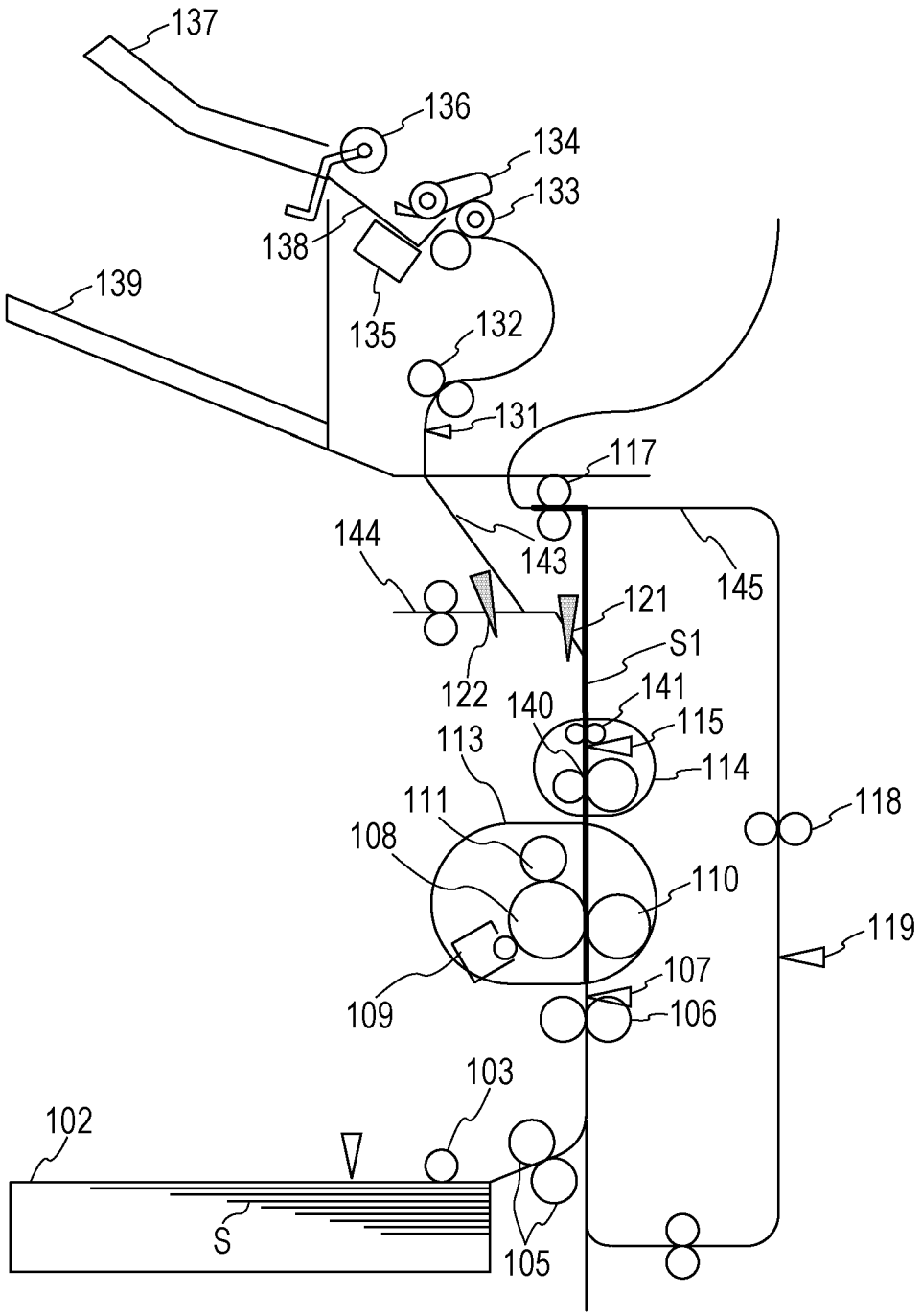

When the CPU 201 determines at S606 that the switching time of the flapper 121 has lapsed, the processing proceeds to S607. At S607, the CPU 201 switches the flapper 121 to the double-sided direction (FIG. 5B). At S608, the CPU 201 determines whether or not time of starting rotation of the roller 117 in a switchback direction has lapsed. When the CPU 201 determines at S608 that the time of starting rotation of the roller 117 in the switchback direction has not lapsed, the processing is returned to S608, and when the CPU 201 determines that the time has lapsed, the processing proceeds to S609. The time of starting rotation of the roller 117 in the switchback direction is obtained based on timing when the trailing edge of the sheet is detected by the fixing sensor 115 and a distance between the fixing sensor 115 and the roller 117 along the conveyance path, and is managed by a timer (not illustrated). Note that, the time of starting rotation of the roller 117 in the switchback direction may be obtained based on timing when the trailing edge of the sheet is detected by the top sensor 107. At S609, the CPU 201 starts rotation of the roller 117 in the switchback direction. Processing of S610 is similar to processing of S410 of FIG. 4, so that the description thereof will be omitted.

Figure 5D:
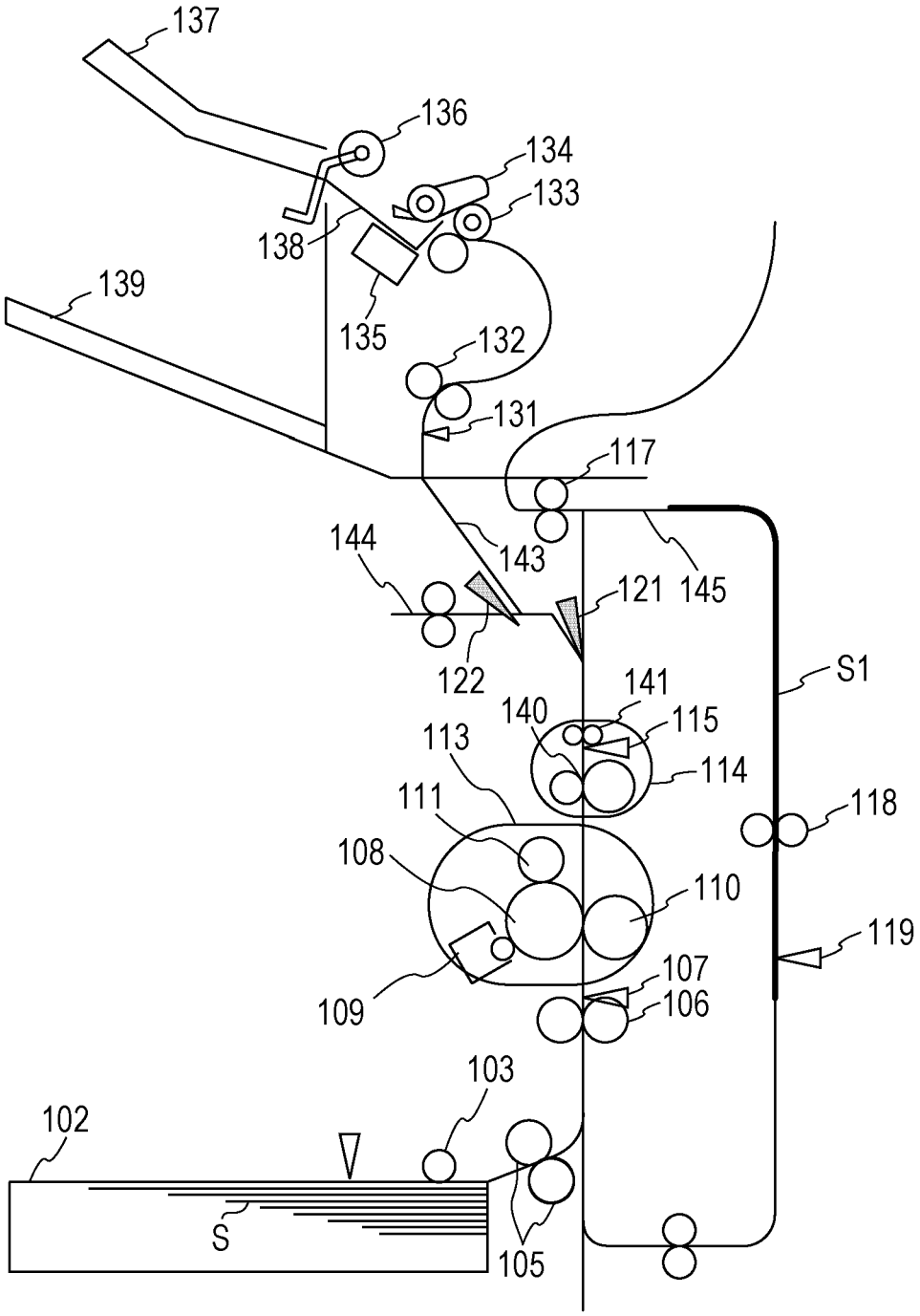
Figure 5E:
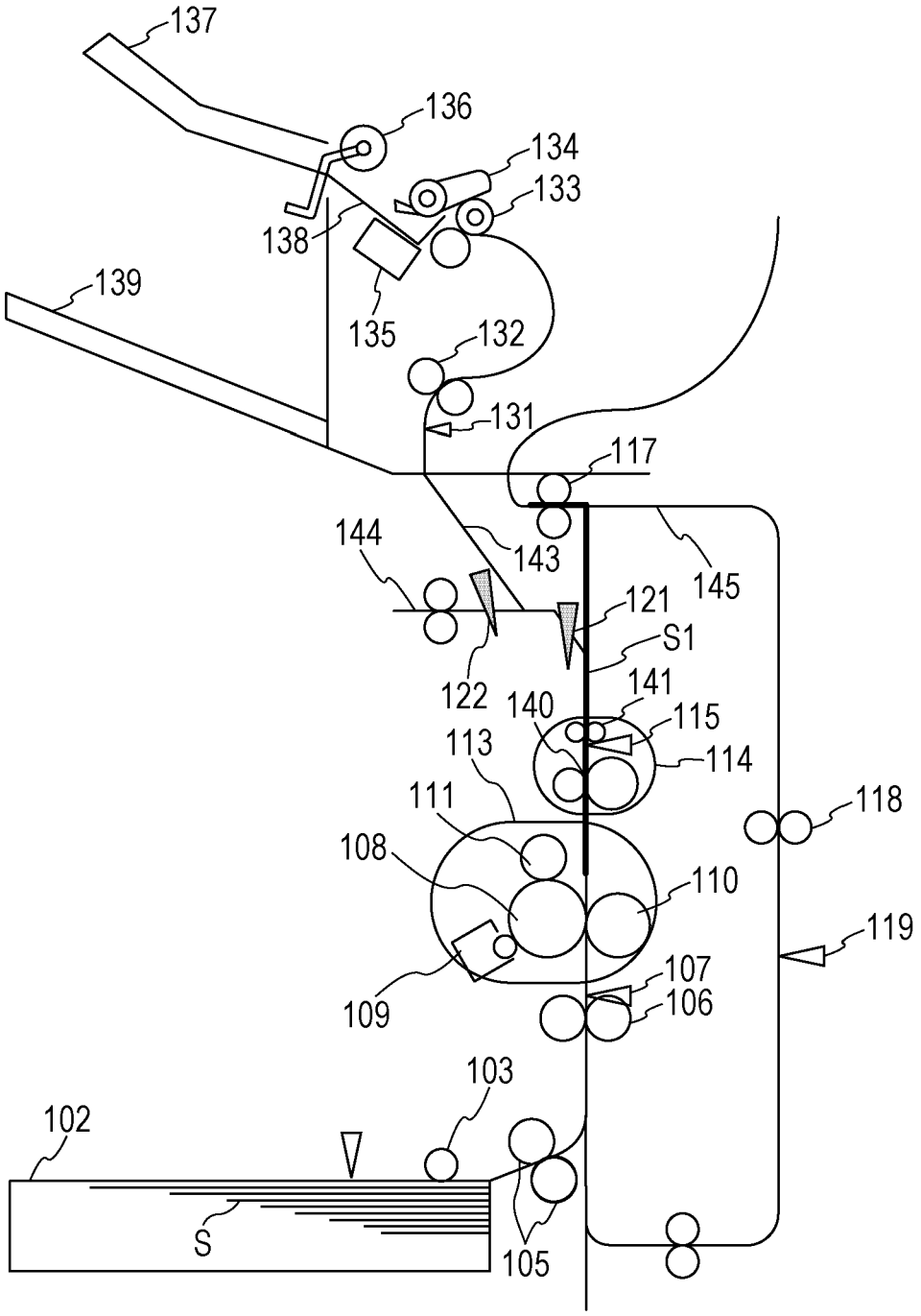

At S611, the CPU 201 determines the sheet length L of the sheet S1 by the detection portion 205. Note that, the detection portion 205 determines the sheet length L in accordance with a time difference between the timing when the leading edge of the sheet S1 is detected by the top sensor 107 and the timing when the trailing edge of the sheet S1 is detected by the top sensor 107. At S612, with the use of the comparison portion 203, the CPU 201 compares the sheet length L of the sheet S1 determined at S612 by the detection portion 205 and the sheet length Lr that is able to be received by the double-sided conveyance path 145, and determines whether or not discharge onto the double-sided conveyance path 145 is allowed. Specifically, when the sheet length L of the sheet S1 measured by the detection portion 205 is equal to or more than the minimum sheet size Lr, the comparison portion 203 determines that the discharge is allowed, and when the sheet length L is less than the minimum sheet size Lr, the comparison portion 203 determines that the discharge is not allowed. The sheet length Lr is stored in the storage portion 204. When the CPU 201 determines at S612 that the sheet S1 is able to be discharged (FIG. 5C) as a result of the comparison by the comparison portion 203, processing for a first side of the sheet S1 ends (FIG. 5D). When the CPU 201 determines at S612 that the sheet S1 is not able to be discharged, that is, the discharge is not allowed (FIG. 5E), the processing proceeds to S613.

At S613, with the use of the determination portion 202, the CPU 201 determines timing of stopping the sheet S1. The CPU 201 stops transfer of a toner image onto the sheet S1, and continues conveyance to a position (predetermined position) at which a whole of the toner image that has been already transferred onto the sheet S1 passes through the nip portion 140, that is, until stop timing has come. At the timing when the whole of the toner image transferred onto the sheet S1 is fixed, the CPU 201 immediately stops the sheet S1 while the sheet S1 is nipped at the nip portion 140, and notifies, to the video controller 210, that the sheet S1 is a sheet that is not able to be conveyed. The CPU 201 stops the printing at S614. As a result, the door 142 is brought into the opened state, and the sheet S1 stopping on the upstream side of the fixing portion 114 is pulled out or the fixing portion 114 is detached, so that the sheet S1 nipped at the nip portion 140 is able to be processed.

As above, according to the present embodiment, it is possible to increase usability when processing is performed for a sheet that is stopped in an image forming apparatus having a configuration in which access is allowed to the upstream side of the fixing portion. Though a case where the double-sided conveyance path 145 is a conveyance path to a double-sided mechanism has been described in the present embodiment, other cases also are able to be applied.

In the aforementioned embodiment, a regulator (trailing-edge regulator, side regulator) that regulates a position of the sheet S stored in the sheet cassette 102 may be provided. A position of the regulator is able to be adjusted in accordance with a size of the sheet S. It may be configured so that a size of the sheet S contained in the sheet cassette 102 is able to be detected from the position of the regulator. In this case, at a time point when the sheet S is fed from the sheet cassette 102, the CPU 201 is able to detect the size of the sheet S. When a detected size L of the sheet S is shorter than La or Lr described above, the CPU 201 may perform control so that the sheet S is not fed from the sheet cassette 102. In the aforementioned embodiment, since the size of the sheet S is unknown at the time point when the sheet S is fed from the sheet cassette 102, the size of the sheet S is detected by the top sensor 107.

On the other hand, when the size L of the sheet S detected based on the position of the regulator is smaller than La or Lr described above, the CPU 201 may perform control so that the sheet S is fed from the sheet cassette 102. This is because there is a case where the position of the regulator is not adjusted correctly in accordance with the size of the sheet S contained in the sheet cassette 102, that is, because there is a case where the size of the sheet S detected by the regulator is different from the actual size of the sheet S. Moreover, as another method of detecting the size of the sheet S before the sheet S is fed from the sheet cassette 102, for example, there is a method of detecting the size of the sheet S based on a printing instruction from a user and information input from an operation panel (not illustrated) provided in the printer 101.

In the embodiment described above, conveyance is continued to a position at which a whole of a toner image transferred onto the sheet S is fixed to prevent a hand of a user from being contaminated, but there is no limitation thereto. In order to make it easy to remove the sheet S, it is only required that conveyance of the sheet S is stopped while the sheet S is nipped at the nip portion 140, and conveyance of the sheet S may be stopped with an unfixed toner image remained.

While the present invention has been described with reference to embodiments, it is to be understood that the invention is not limited to the disclosed embodiments. The scope of the following claims is to be accorded the broadest interpretation to encompass all such modifications and equivalent structures and functions.

This application claims the benefit of Japanese Patent Application No. 2016-095270 filed May 11, 2016, which is hereby incorporated by reference herein in its entirety.

What is claimed is:

1. An image forming apparatus comprising:

an image forming unit configured to form an image on a recording material;

a fixing unit configured to fix the image formed by the image forming unit on the recording material at a nip portion;

a conveyance path configured to convey a recording material on which the image has been fixed by the fixing unit, wherein the image forming apparatus is configured such that a recording material, whose length in a conveyance direction is equal to or longer than a threshold length, is able to be conveyed in the conveyance path, and a recording material, whose length in the conveyance direction is shorter than the threshold length, is not able to be conveyed in the conveyance path; and a control unit configured to perform control, wherein, in a case where it is detected that a length of a predetermined recording material is shorter than the threshold lenght while the predetermined recording material is being conveyed toward the conveyance path, the control unit performs control to stop conveyance of the predetermined recording material in a state where the predetermined recording material is nipped at the nip portion.

2. The image forming apparatus according to claim 1, wherein, before stopping conveyance of the predetermined recording material, the control unit causes the image forming unit to stop formation of an image on the predetermined recording material and causes the fixing unit to fix a whole of the image formed on the predetermined recording material.

3. The image forming apparatus according to claim 1, wherein the threshold length is a length of a first recording material in the conveyance direction, and wherein the first recording material has a shortest length in the conveyance direction among recording materials that are able to be conveyed to the conveyance path.

4. The image forming apparatus according to claim 3, wherein the conveyance path is a first conveyance path through which a recording material is guided to a post-processing apparatus that applies post-processing to the guided recording material, wherein a first conveyance member is configured to be arranged on a most downstream side in the conveyance direction among conveyance members provided on the first conveyance path, wherein a second conveyance member is configured to be arranged on a most upstream side in the conveyance direction among conveyance members provided on a conveyance path which is connected to the first conveyance path and provided in the post-processing apparatus, and wherein a length of the first recording material in the conveyance direction is equal to or longer than a distance between the first conveyance member and the second conveyance member along the first conveyance path and the conveyance path in the post-processing apparatus.

5. The image forming apparatus according to claim 3, wherein the conveyance path is a double-sided conveyance path in which a recording material is conveyed to form an image on a second side of the recording material having an image formed on a first side of the recording material, wherein a third conveyance member is configured to switch a conveyance direction of a recording material, on which an image has been fixed by the fixing unit, to convey the recording material to the double-sided conveyance path, wherein a fourth conveyance member is configured to be arranged on a most upstream side in the conveyance direction among conveyance members provided on the double-sided conveyance path, and wherein a length of the first recording material in the conveyance direction is equal to or longer than a distance between the third conveyance member and the fourth conveyance member along the double-sided conveyance path.

6. The image forming apparatus according to claim 1, further comprising a door for accessing the fixing unit, wherein, in a case where the predetermined recording material is stopped in the state where the predetermined recording material is nipped at the nip portion, the image forming apparatus is configured to allow a user to remove the predetermined recording material through the door and out of the image forming apparatus.

7. The image forming apparatus according to claim 1, further comprising a first detection sensor configured to be arranged on an upstream side of the image forming unit in the conveyance direction, wherein the control unit determines a length of the predetermined recording material in the conveyance direction based on a detection result by the first detection sensor.

8. The image forming apparatus according to claim 7, wherein the conveyance path is a first conveyance path, the image forming apparatus further comprising:

a stacking portion on which a recording material discharged outside the image forming apparatus is to be stacked;

a second conveyance path that is different from the first conveyance path, wherein the image forming apparatus is configured such that a recording material on which an image has been fixed by the fixing unit is able to be guided through the second conveyance path to the stacking portion;

a second detection sensor configured to be arranged on a downstream side of the fixing unit in the conveyance direction; and a switching member configured to switch a conveyance destination of the recording material between the second conveyance path and the first conveyance path, wherein the control unit switches the switching member based on timing when a leading edge of the recording material is detected by the second detection sensor.

9. The image forming apparatus according to claim 8, wherein a length of the recording material in the conveyance direction is determined based on (i) a conveyance speed of the recording material and (ii) a time after a leading edge is detected by the first detection sensor until a trailing edge of a recording material is detected by the first detection sensor, and wherein the leading edge of the recording material is determined to have passed through the switching member at timing when the trailing edge of the recording material is detected by the first detection sensor.

10. The image forming apparatus according to claim 8, wherein the threshold length is longer than a length of a second recording material in the conveyance direction, and wherein the second recording material has a shortest length in the conveyance direction among recording materials that are able to be conveyed to the second conveyance path.

11. The image forming apparatus according to claim 10, further comprising a feeding member configured to feed a recording material contained in a container, wherein a fifth conveyance member is configured to be provided on an upstream side of the first detection sensor in the conveyance direction and to convey the recording material fed by the feeding member, and wherein a length of the second recording material in the conveyance direction is equal to or longer than a distance between the feeding member and the fifth conveyance member along the first conveyance path.

12. A method for an image forming apparatus having a conveyance path configured to convey a recording material on which the image has been fixed by a fixing unit, the method comprising:

forming, via an image forming unit, an image on a recording material;

fixing, via the fixing unit, the image formed by the image forming unit on the recording material at a nip portion, wherein the image forming apparatus is configured such that a recording material, whose length in a conveyance direction is equal to or longer than a threshold length, is able to be conveyed in the conveyance path, and a recording material, whose length in the conveyance direction is shorter than the threshold length, is not able to be conveyed in the conveyance path; and performing control, wherein, in a case where it is detected that a length of a predetermined recording material is shorter than the threshold length while the predetermined recording material is being conveyed toward the conveyance path, performing control includes performing control to stop conveyance of the predetermined recording material in a state where the predetermined recording material is nipped at the nip portion.

13. The method according to claim 12, wherein, before stopping conveyance of the predetermined recording material, performing control includes causing the image forming unit to stop formation of an image on the predetermined recording material and causing the fixing unit to fix a whole of the image formed on the predetermined recording material.

14. The method according to claim 12, wherein the threshold length is a length of a first recording material in the conveyance direction, wherein the first recording material has a shortest length in the conveyance direction among recording materials that are able to be conveyed to the conveyance path, wherein the conveyance path is a first conveyance path through which a recording material is guided to a post-processing apparatus that applies post-processing to the guided recording material, wherein a first conveyance member is configured to be arranged on a most downstream side in the conveyance direction among conveyance members provided on the first conveyance, wherein a second conveyance member is configured to be arranged on a most upstream side in the conveyance direction among conveyance members provided on a conveyance path which is connected to the first conveyance path and provided in the post-processing apparatus, and wherein a length of the first recording material in the conveyance direction is equal to or longer than a distance between the first conveyance member and the second conveyance member along the first conveyance path and the conveyance path in the post-processing apparatus.

15. The method according to claim 14, wherein the conveyance path is a double-sided conveyance path in which a recording material is conveyed to form an image on a second side of the recording material having an image formed on a first side of the recording material, wherein a third conveyance member is configured to switch a conveyance direction of a recording material, on which an image has been fixed by the fixing unit, to convey the recording material to the double-sided conveyance path, wherein a fourth conveyance member is configured to be arranged on a most upstream side in the conveyance direction among conveyance members provided on the double-sided conveyance path, and wherein a length of the first recording material in the conveyance direction is equal to or longer than a distance between the third conveyance member and the fourth conveyance member along the double-sided conveyance path.

16. The method according to claim 12, further comprising receiving user access to the fixing unit through a door of the image forming apparatus, wherein, in a case where the predetermined recording material is stopped in the state where the predetermined recording material is nipped at the nip portion, the image forming apparatus is configured to allow a user to remove the predetermined recording material through the door and out of the image forming apparatus.

17. The method according to claim 12, further comprising determining a length of the predetermined recording material in the conveyance direction via a first detection sensor configured to be arranged on an upstream side of the image forming unit in the conveyance direction.

18. The method according to claim 17, wherein the conveyance path is a first conveyance path and the image forming apparatus further includes a stacking portion, a second conveyance path that is different from the first conveyance path, a second detection sensor configured to be arranged on a downstream side of the fixing unit in the conveyance direction, and a switching member, the method further comprising:

stacking, on the stacking portion, a recording material discharged outside the image forming apparatus, wherein the image forming apparatus is configured such that a recording material on which an image has been fixed by the fixing unit is able to be guided through the second conveyance path to the stacking portion; and switching, via the switching member, a conveyance destination of the recording material between the second conveyance path and the first conveyance path, wherein performing control includes switching the switching member based on timing when a leading edge of the recording material is detected by the second detection sensor.

19. The method according to claim 18, wherein a length of the recording material in the conveyance direction is determined based on (i) a conveyance speed of the recording material and (ii) a time after a leading edge is detected by the first detection sensor until a trailing edge of a recording material is detected by the first detection sensor, and wherein the leading edge of the recording material is determined to have passed through the switching member at timing when the trailing edge of the recording material is detected by the first detection sensor.

20. The method according to claim 18, further comprising feeding, via a feeding member, a recording material contained in a container, wherein the threshold length is longer than a length of a second recording material in the conveyance direction, wherein the second recording material has a shortest length in the conveyance direction among recording materials that are able to be conveyed to the second conveyance path wherein a fifth conveyance member is configured to be provided on an upstream side of the first detection sensor in the conveyance direction and to convey the recording material fed by the feeding member, and wherein a length of the second recording material in the conveyance direction is equal to or longer than a distance between the feeding member and the fifth conveyance member along the first conveyance path.

* * * * *